United States Patent [19]

Smith

[11] Patent Number: 4,725,350

[45] Date of Patent: Feb. 16, 1988

[54] PROCESS FOR EXTRACTING OIL AND HYDROCARBONS FROM CRUSHED SOLIDS USING HYDROGEN RICH SYN GAS

[76] Inventor: Anthon L. Smith, 974 N. Murdock Dr., Pleasant Grove, Utah

[21] Appl. No.: 452,629

[22] Filed: Dec. 22, 1982

Related U.S. Application Data

[63] Continuation-in-part of Ser. No. 234,119, Feb. 13, 1981, abandoned.

[51] Int. Cl.[4] ..... C10G 1/00

[52] U.S. Cl. ..... 208/408; 208/414

[58] Field of Search ..... 208/8 R, 11 R, 408

[56] References Cited

U.S. PATENT DOCUMENTS

| | | | |
|---|---|---|---|
| 609,920 | 8/1898 | Stowe | 202/216 |
| 2,009,122 | 7/1935 | Reed et al. | 202/218 |
| 2,664,389 | 11/1953 | Rex et al. | 201/33 |
| 2,905,595 | 9/1955 | Berg | 201/29 X |
| 3,244,615 | 4/1966 | Huntington | 208/11 R |
| 3,265,608 | 8/1966 | Crawford | 208/8 R |
| 3,496,094 | 2/1970 | Smith | 208/11 R |
| 3,617,472 | 11/1971 | Schlinger et al. | 208/11 R |
| 3,895,936 | 6/1975 | Toepell | 75/36 |
| 3,922,215 | 11/1975 | Linden et al. | 208/11 R |

FOREIGN PATENT DOCUMENTS

| | | | |
|---|---|---|---|
| 1326455 | 8/1973 | United Kingdom | 208/11 R |

*Primary Examiner*—Curtis R. Davis
*Assistant Examiner*—Glenn Caldarola
*Attorney, Agent, or Firm*—Thorpe, North and Western

[57] ABSTRACT

Process and apparatus for extraction of oil and hydrocarbons from crushed hydrocarbonaceous solids, such as tar sands, involving the pyrolyzing of the said solids with syn gas rich in hydrogen, and preferably syn gas obtained from the gasification of coal. Crushed hydrocarbonaceous solids are treated with hot syn gas containing hydrogen at an elevated temperature in a rotary kiln where the crushed solids are cascaded into the hot syn gas containing hydrogen for sufficient time to strip the volatile liquids and gases found in the said solids, removing the vaporized liquids, enriched syn gas and spent crushed solids from the kiln, fractionating the vaporized liquids and enriched syn gas into desired fractions, and utilizing the enriched syn gas in the preparation of desired by-products. The apparatus includes an improved rotary kiln which speeds the pyrolysis of the crushed solids.

17 Claims, 3 Drawing Figures

PROCESS FOR EXTRACTING OIL AND HYDROCARBONS FROM CRUSHED SOLIDS USING HYDROGEN RICH SYN GAS

This application is a continuation-in-part of my application Ser. No. 234,119, filed Feb. 13, 1981, entitled "Process and Apparatus for Extracting Oil and Hydrocarbons From Crushed Solids Using Hydrogen Rich Syn Gas, abandoned.

BACKGROUND OF THE INVENTION

World wide demand for hydrocarbons and related fertilizers and petrochemicals is increasing at a rapid annual rate. Crude petroleum and natural gas are basic in satisfying these demands but many industries have experienced shortages even though new oil and gas sources are being discovered. Therefore, alternate sources and feed stocks, such as coal, tar sands, oil shale and solid crudes are receiving greater consideration.

Tar sands, also known as oil sands and bituminous sands, are a particularly promising source of these needed products as large deposits are found in Canada and the United States. The largest deposits of the sands are the Athabasca sands found in northern Alberta, Canada where two commercial plants are in operation to recover synthetic oil from the sand. The Canadian tar sands underlay more than 13,000 square miles at a depth up to 2,000 ft. Of the 24 states in the United States that contain tar sands, about 90% of such deposits are in the state of Utah. The hydrocarbon resource locked in the Utah tar sands has been estimated to be in excess of 25 billion barrels. This presently untouched resource is quite significant when compared to the U.S. crude oil proven reserve of only about 31 billion barrels.

The demand for hydrocarbon resources makes development of Utah's tar sand virtually certain. However, the Utah tar sands, being of non-marine origin, have somewhat different chemical and physical characteristics than the Athabascan sands which are of marine origin, and do not respond as well to the process previously used to extract the oil from the tar sands. Utah tar sands are generally hard consolidated sand stone closely associated with petroliferous material (heavy viscous oil material) which is as high as 13% by weight with an average of 10.5% by weight. The oil is about 13°–18° API gravity and contains a low amount of sulfur, e.g. about 0.55% by weight, and low aromaticity.

The Utah tar sands also differ from the Canadian sands in that they have a very low water content. The Athabascan sand has an encapsulating water film surrounding each sand grain, which makes it amenable to a water-wetting process. The absence of this water film on the Utah sand grain necessitates using other technology for extracting the oils.

A comparison of the Athabascan tar sands with a sample of Utah tar sands obtained from Asphalt Ridge is shown in the following table:

| | Athabasca Sands | Asphalt Ridge Sands |
|---|---|---|
| Carbon (wt-pct) | 82.6 | 84.4 |
| Hydrogen | 10.3 | 11.0 |
| Nitrogen | .47 | 1.0 |
| Sulfur | 4.86 | .75 |
| Oxygen | 1.8 | 3.3 |
| Average Mol. Wt (VPO-benzene) | 568 | 820 |

-continued

| | Athabasca Sands | Asphalt Ridge Sands |
|---|---|---|
| Viscosity (poise) 77° F. (cone-plate at 0.05 sec | 6,380 | 325,000 |
| Pct volatile material (535° C.) | 60.4 | 49.9 |

The high viscosity, low sulfur content, low water content and other significant differences keep the Utah tar sands from responding well to known extraction processes.

A number of oil recovery methods related to oil shale and tar sands have been tested in the laboratory or in small operations in the filed. Examples of such prior known methods include those described in U.S. Pat. Nos. 4,218,304; 4,160,720; 4,199,432; 4,197,183; 3,440,162; 3,475,319 and 3,318,798. These processes involve various techniques such as hot water processes, cold water processes, solvent processes and thermal processes and the like, but in most cases, they possess certain limitations which make them unsuitable for use on a commercial basis with the Utah tar sands. A process which would be effective with these particular tar sands would be a significant advance in the art.

British Pat. No. 1,326,455 discloses a method for hydrotorting of shale to produce shale oil. However, in this case water is added to the reaction zone and this causes considerable difficulties including the need for large amounts of heat to remove the water at a later stage. In addition, they employ a slurry mix which adds to the difficulty of operation.

It is an object of the invention, therefore, to provide a new and efficient process for the extraction of hydrocarbonaceous material from solids containing such material and particularly from Utah tar sands. It is a further object to provide such an extraction process which could utilize equipment now in commercial use, meet present day EPA standards and could be rapidly put into commercial production to meet the urgent demand for hydrocarbon products.

SUMMARY OF THE INVENTION

It has now been discovered that these and other objects can be accomplished by the process of the invention which relates to a new and improved process for extracting oil and other valuable hydrocarbons from crushed hydrocarbonaceous solids, and preferably tar sands, by means of thermal technique using a special source of heat.

Specifically, the invention provides a new and efficient process for extracting valuable oils and other hydrocarbons from crushed hydrocarbonaceous solids, and especially the Utah tar sands which comprises preheating the crushed hydrocarbonaceous solids to remove residual water, treating the crushed hydrocarbonaceous solids with hot syn gas containing hydrogen and carbon monoxide, and preferably syn gas obtained directly from a coal gasification process, at a low pressure, e.g. pressure between 5 psi and 15 psi, and in the absence of water, where the crushed solids are cascaded into the hot syn gas containing hydrogen for sufficient time to strip the volatile liquids and gases found in the said solids, removing the vaporized liquids and enriched syn gas and stripped solids from the kiln, fractionating the vaporized liquids and enriched gas into desired fractions and utilizing the enriched syn gas in preparation of additional by-products such as methanol or ammonia.

The new process presents distinct advantages over the known processes for extraction of oil from tar sands, and is particularly adapted for use in the treatment of tar sands obtained from Utah deposits. Particular advantage is found in the fact that the Utah tar sands are located near large deposits of coal and there could be a unique combination of the two techniques of coal gasification and the utilization of the syn gas therefrom directly in the tar sand extraction process. In addition, the use of the special hydrogen-containing hot gas effects an upgrading of the products as to yield and quality, e.g. 5 to 25% increase in yield of light ends, as gasoline, and thus presents a desirable economic advantage over known techniques. Further, by using waste heat gas, no burning occurs so there are no acid gases, nitric oxides or emissions of harmful gases that are not well below the EPA standards.

Further, no water is present in the reaction zone as any residual water is removed during the preheat stage. This has many unexpected advantages, such as lower heat requirement during the reaction, as well as improved yield. Furthermore, there would be no need for building expensive dams and other water collection projects prior to the operation of the process. In addition, the process utilizes equipment now in commercial production and does not require specially produced equipment which may require long periods of time for construction.

Finally the process presents an additional economic advantage in that the oil vaporized off the sand will be in vapor form and can be sent directly to a fractionating tower for refining, thereby eliminating the expense of reheating the crude before it can be processed. The hot syn gas also recovered from the kiln is suited for use in the preparation of other valuable by-products such as methanol or liquid ammonia.

DETAILED DESCRIPTION OF THE INVENTION AND PREFERRED EMBODIMENTS

While the process of the invention is described hereinafter with particular reference to the processing of tar sands and especially Utah tar sands, it will be apparent that the process can also be used to treat a great variety of other different hydrocarbon-containing solids, such as oil shale, solid crude oil, gilsonite, peat, etc. and mixtures of two or more of these materials, or any other hydrocarbon-containing solids with inert materials.

Figure 1:
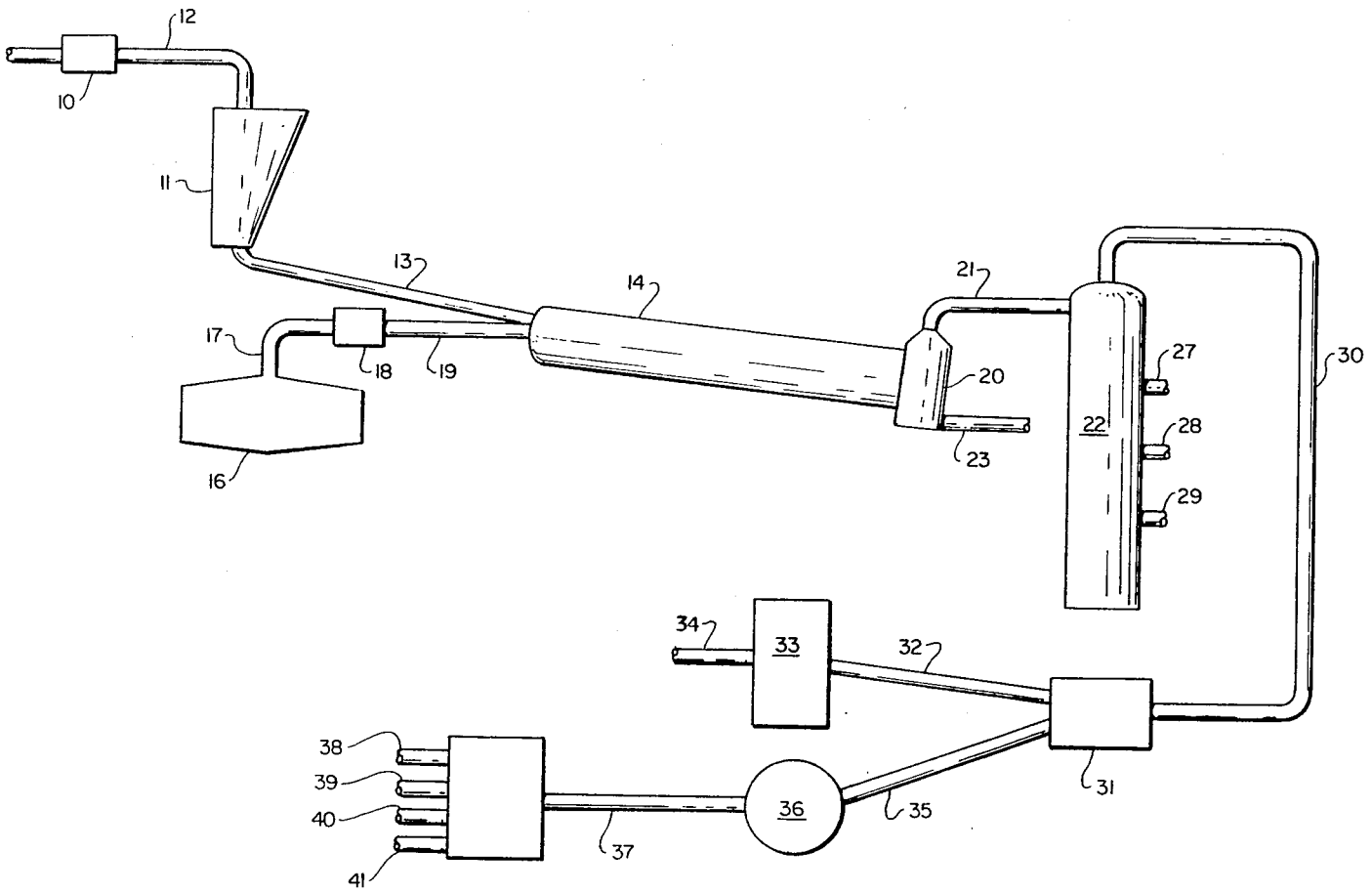
FIG. 1 is a schematic diagram of one embodiment of the apparatus and flow path for carrying out the process of the invention.
Figure 2:
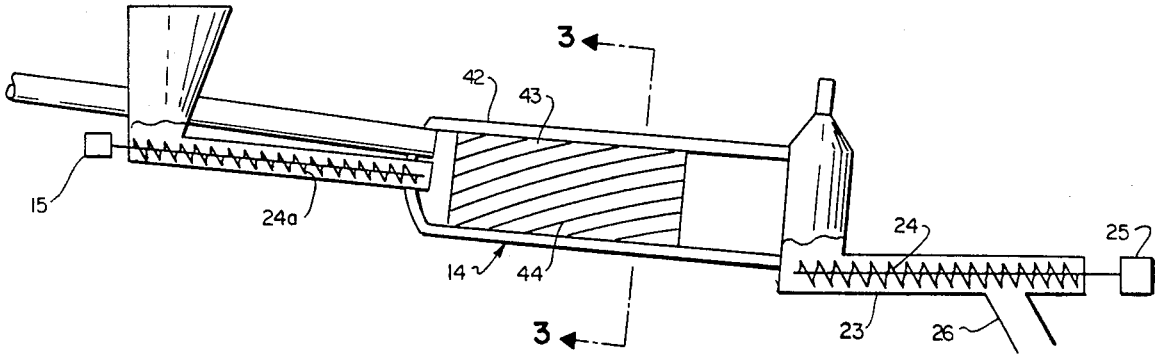
FIG. 2 is a side cross-sectional view of a rotary kiln which is preferably used in the process of the invention.
Figure 3:
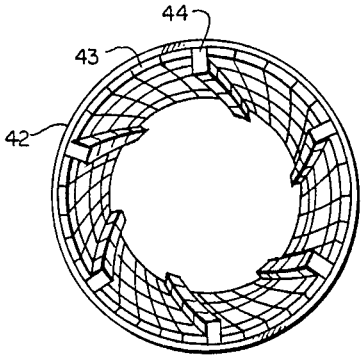
FIG. 3 is a drawing showing a preferred structure within the kiln.

FIGS. 1–3 show one complete embodiment of the invention. Crushed hydrocarbonaceous solids, such as crushed tar sands, are preheated at vessel 10, taken to hopper 11 through line 12 and then to rotary kiln 14 through line 13 which contains a screw conveyor 24a driven by motor 15. Hot syn gas containing hydrogen produced in coal gasifier 16 is taken through line 17 to heat exchanger 18 where it is brought to the desired temperature and then to rotary kiln 14 through line 19. The point of entry of line 19 being such that the crushed solids from line 13 entering kiln 14 cascade over the hot syn gas. The rotation of the kiln is adjusted as needed to bring about the desired separation and volatilization of the hydrocarbonaceous material on the sand particles. The resulting vapors and residual solids are taken from the kiln 14 to separation hopper 20 where the vapors are discharged through line 21 to fractionation column 22 and the solids enter 23 for disposal. Line 23 contains a screw conveyor 24 driven by motor 25 and interconnects line 26 through which the solids are discharged. The vapors are fractionated in column 22 to recover the desired fractions such as gasoline through line 27, heating oil through line 28 and heavy distillates through line 29. The enriched sun gas removed from the top of fractionation column 22 through line 30 is taken to tank 31 where a portion of the gas is taken through line 32 to reactor 33 where it is combined with nitrogen (from coal gasifier) to form liquid ammonia which is removed through 34. A portion of the enriched syn gas is taken from tank 31 through line 35 to catalytic converter 36 for conversion to methanol which is taken through line 37 for further conversion to products such as gasoline, line 38; propane, line 309, 1000 BTU gas line 40, and water at line 41.

FIG. 2 illustrates by cross-section, a generally horizontal rotary kiln that can be used in the process of the invention. It is preferably constructed of a steel shell 42 and lined with fire brick 43. The bricks are arranged so as to have certain bricks 44 set on end rather than flat so as to present a series of spiralling baffles such as the lands in a rifle barrel. The baffles extend only about ¾ of the length of the kiln leaving the last quarter containing just the fire brick liner.

FIG. 3 is a transverse cross-sectional view of the rotary kiln through lines 3—3 of FIG. 2 showing a suggested arrangement of the fire brick baffles 44. In a rotary kiln of about 6 feet in diameter, the baffles are preferably arranged so as to be about 2 to 4 feet apart. Thus, as the kiln rotates, the baffles cause the sand particles to be agitated thereby improving exposure of each sand particle to the hot syn gas resulting in increased removal of hydrocarbons.

The hot syn gas containing hydrogen to be used in the process of the invention can be obtained from any suitable source. The gas employed in the process should contain at least 25% hydrogen, and preferably 30% to 40%. The gas should be at an elevated temperature and preferably a temperature of at least 1000° F., and more preferably from 1000° F. to 3000° F. Coming under special consideration is hot syn gas containing from 25% to 35% hydrogen and a temperature of 1500° F. to 2500° F.

The preferred gas to be employed in the process of the invention is that obtained from the gasification of coal, such as by the Koppers-Totzek process as described in Oil and Gas Journal, June 19, 1972, page 26. According to that process, a mixture of steam and oxygen entrains the pulverized coal and gasifies it in the combustion chamber, producing a high temperature of about 3500° F. The gas that is produced is essentially carbon monoxide, hydrogen and carbon dioxide with a relatively small percentage of nitrogen, hydrogen and carbon dioxide with a relatively small percentage of nitrogen, hydrogen sulfide, carbonyl sulfide, and only traces of other compounds. More than 50% of the ash drops down through a quench and is eliminated in gas stream. A coal gasifier for example, using 3,400 tons of coal a day will produce over 364 million cu. ft. of 800 BTU gas daily. This should be sufficient to produce 40,000 barrels a day of oil from tar sands containing 12% oil.

Further advantage of using the hot syn gas from the gasification of coal by the Koppers-Totzek process is found in the fact that this technique produces large amounts of nitrogen in the oxygen step and this can be further reacted with the enriched syn gas from the present process to produce valuable anhydrous ammonia as a by-product. Production of ammonia in this manner appears more reliable than the present techniques of producing ammonia from natural gas.

The coal used in the production of the syn gas can be obtained from any suitable source, e.g., can contain large or small amounts of sulfur and variable heat content. Data obtained from three products found to be useful in producing syn gas for the process of the present invention is illustrated in the following table:

| TYPE OF FUEL | WESTERN COAL | EASTERN COAL | GREEN PET COKE |
|---|---|---|---|
| Gasifier Feed | | | |
| Analysis (% wt) | | | |
| C | 72.7 | 69.9 | 88.0 |
| H | 5.3 | 4.9 | 4.5 |
| N | 1.1 | 1.3 | 1.4 |
| S | 1.0 | 1.1 | 4.3 |
| O | 9.0 | 7.1 | 1.0 |
| Moisture | 2.0 | 2.0 | 0.6 |
| Gross Heating value of Dry Feed, BTU/lb | 13,135 | 12,640 | 15,690 |
| Oxygen, Tons/Ton Dried Feed at 98% purity | 0.878 | 0.849 | 0.950 |
| Process Steam, 1 lb/ton Dried Feed | 814 | 810 | 1182 |
| Gasifier Products | | | |
| Jacket Steam, 1 lb/ton Dried Feed | 600 | 554 | 629 |
| High Pressure Steam, 1 lb/ton Dried Feed at 900° F./900 psig | 2760 | 2675 | 3598 |
| Raw Gas Analysis Vol % Dry | | | |
| CO | 52.55 | 52.51 | 52.22 |
| $CO_2$ | 10.00 | 10.00 | 10.00 |
| $H_2$ | 35.96 | 35.90 | 35.40 |
| $N_2$—Argon | 1.00 | 1.15 | 1.10 |
| $H_2S$ | 0.34 | 0.36 | 1.20 |
| COS | 0.02 | 0.02 | 0.08 |
| Gas Gross Heating Value BTU/SCF, Dry | 287 | 286 | 283 |
| % Heating Value of Gas/Heating (value feed (Gross Basis) | 76.1 | 75.8 | 69.9 |

The hot gases leaving the gasifier have a temperature of about 2,750° F. and are preferably cooled before being utilized in the process of the invention. The temperature of the syn gas to be introduced into the rotary kiln will vary depending upon the product being treated in the kiln, preheat temperature of the crushed solids and the residence time in the rotary kiln. In most cases, temperature of the gas will vary from about 1,000° F. to 2,500° F. and more preferably at about 1,500° F. This will generally necessitate cooling of the hot syn gas before introduction into the rotary kiln. The cooling can be accomplished by any suitable means, but is preferably accomplished by use of the conventional heat exchanger as shown in FIG. 1.

One employs a very low pressure in the rotary kiln which will vary over a very narrow range, e.g. 5 psi to 15 psi. Preferred pressures vary from about 5 psi to 10 psi.

Catalysts need not be employed in the process of the invention to obtain the desired results, but in some cases it may be desirable to accelerate the production of certain products to employ catalytic materials in the rotary kiln.

As noted above, the hydrocarbonaceous solids used in the process of the invention may be any solid material having hydrocarbons dispersed within or on the said solids. Preferably the solids contain at least 8% and preferably 10% to 50% by-weight of hydrocarbon materials. Such hydrocarbonaceous material includes, among others, oil shale, tar sands, solid crude oil, gilsonite peat, etc. and mixtures of two or more of these materials. The nature of the hydrocarbon material may vary over a wide range depending upon the type and origin of the said material. The hydrocarbonaceous material contained within the tar sands generally has an analysis such as: Carbon (wt-pct) 70–90% Hydrogen 7 to 15% Nitrogen 0.3 to 3% Sulfur 0.5 to 8% Oxygen 1 to 6%.

The above-described solid materials are crushed into small particles before introduction into the rotary kiln. Particle size preferably ranges from about 0.1 to 1 inch and more preferably from 0.25 to 0.75 inches. The use of the rotary kiln as described above permits the use of particles having very fine particle size such as those that might be present in the solid materials of the type found in oil shale deposits.

The crushed solid materials are preheated before introduction into the rotary kiln. Preheat temperatures may vary over a wide range depending upon the material being treated and the temperature of the syn gas containing hydrogen to be used in the reaction kiln. Preferred preheat temperatures range from about 100° F. to about 350° F. and still more preferably from 200° F. to about 250° F. The preheating can be accomplished before being introduced into the hopper or while being maintained in the hopper. Conventional heating equipment may be used for this purpose. BTUs obtained from the spent solids recovered at the end of the process of the invention is a suitable source of heat for this preheat step The preheated crushed solid particles are introduced at one end of the rotary kiln and preferably at a point such that the particles cascade down over the hot syn gas being introduced at a lower point in the kiln. The transfer of the solids from the hopper to kiln is preferably accomplished by way of a screw conveyor or weir.

As the temperature employed in the kiln is important it is necessary to maintain proper preheat temperature and syn gas temperature to effect the needed temperature in the kiln. Shown below is an illustration of the relationship of preheat temperature and syn gas temperature to bring about the desired kiln temperature:

| RUN NO. | BARRELS/ DAY OIL | PRE-HEAT °F. | SYN GAS TEMP °F. | TEMPERATURE IN KILN |
|---|---|---|---|---|
| 1 | 10,000 | 250 | 1,800 | 700 |
| 2 | 10 000 | 350 | 2,500 | 572 |
| 3 | 3,670 | 350 | 2,500 | 900 |
| 4 | 1,380 | 60 | 1,800 | 900 |

Preferably, the parameters are adjusted so that the temperature in the kiln is between 600° F. and 1,000° F. and preferably between 700° F. and 900° F.

As shown in FIGS. 1 and 2, the kiln is in a generally horizontal position with a slight slope (e.g. about 3°-5°) and is rotated as needed to maintain the desired residence time. At 10% load and residence time of about 12 minutes, the rotation is preferably between 2 and 5 rpm.

The residence time in the kiln will vary depending upon the type of solid being treated, particle size, rate of addition, syn gas temperature and rate of rotation of the kiln. These parameters should be adjusted so that the particles remain in the kiln until they are substantially stripped of the hydrocarbonaceous material contained therein. In most cases, the solids leaving the kiln should have no more than 1 or 2% of hydrocarbonaceous material remaining on the solid particles. At syn gas temperature of about 700° F. to 900° F. and particle size of about ¾ inch of tar sands, a residence time of about 10 to 20 minutes should be sufficient to effect the necessary separation. Parameters are also controlled so as to minimize the secondary decomposition of the hydrocarbon material to form coke. This can be accomplished in most cases by use of lower temperatures and shorter reaction periods.

The removal of the oil and hydrocarbons is greatly facilitated by the construction of the rotary kiln as shown in FIGS. 2 and 3. The kiln as shown is lined with fire brick with certain of the brick set on end so as to form a series of baffles such as present in a rifle barrel. The baffles extend only into about ¾ of the kiln leaving the last quarter containing just the fire brick liner. This permits a gradual shifting of the solid particles down through the kiln and affords maximum exposure of the gas to the sand particles and thus effect a more efficient removal of the hydrocarbons from the said particles.

The hydrogen in the hot syn gas introduced into the kiln plays a significant role in the bringing about the desired results. The hydrogen not only facilitates removal of the hydrocarbons imbedded in the particles, but much of the sulfur present in the crushed solids will be picked up by the hydrogen and carried to a sulfur removal unit. Hydrogen will also react with the vapors deficient in hydrogen and form more light ends for removal at the fractionation step. As noted, the presence of the hydrogen brings about a 5% to 25% increase in yield of light end products as compared to the conventional thermal process using gas free of hydrogen.

At the end of the residence period, the vapors, gas and residual solids are discharged to the separation hopper where the vapors and gas are separated from the spent solids. Optionally, the vapors and gas may be taken to a cyclone (not shown) where any small fines are removed and then to the fractionation column where they can be easily spearated into the desired fractions. The solids are removed by means of a screw conveyor and taken to the disposal unit, or unit where the BTUs can be removed and utilized in the preheating of raw crushed sand particles to be introduced into the rotary kiln.

The products taken from the kiln comprise gases ($C_5$ and lighter), 5-10% volatilized condensates ($C_6$-535° C.), 60-85% coke and 5-10% spent sand. Product yield from various types of tar sands can be illustrated by the following:

| PRODUCT | ATH | TST | AR | PRS | WIL |
|---|---|---|---|---|---|
| Gases | 7.52 | 5.31 | 4.80 | 7.41 | 6.03 |
| Condensates | 76.52 | 72.82 | 82.85 | 76.05 | 77.04 |

-continued

| PRODUCT | ATH | TST | AR | PRS | WIL |
|---|---|---|---|---|---|
| Coke | 15.90 | 21.87 | 12.35 | 16.54 | 16.93 |

ATH-Athabasca Sands
TST-Tar Sand Triangle
AR-Asphalt Ridge
PRS-P. R. Spring
WIL-Wilmington Gaseous products analyzed by gas chromatography and mass spectrometry gave the following results as to the Tar Sand Triangle gases:

| COMPOUND | Moles, pct Helium free basis |
|---|---|
| Hydrogen | 14.3 |
| Methane | 47.3 |
| Ethylene | 1.6 |
| Ethane | 10.9 |
| Propylene | 3.1 |
| Propane | 5.5 |
| 1,3-butadiene | 0.1 |
| Butenes | 2.6 |
| Iso-butane | 0.0 |
| n-Butane | 2.2 |
| Cyclopentane | 0.1 |
| Pentenes | .7 |
| Isopentenes | .3 |
| N—Pentane | 1.3 |
| Ammonia | .7 |
| Hydrogen sulfide | 5.0 |
| Carbon monoxide | 3.9 |
| Carbon dioxide | .4 |
| | 100.0 |

Typical analysis of the condensates is shown in the following table giving the carbon and ring analysis of condensates obtained from the Tar Sand Triangle pyrolysis:

| TYPE | ATOMIC PCT OF CARBON |
|---|---|
| Aromatic carbon | 18-20 |
| Naphthenic carbon (saturated) | 9-16 |
| Olefin carbon | 10-12 |
| Paraffinic carbon | 55-60 |
| Aromatic rings/molecule | .07 |
| Naphthenic-olefin rings molecules | 1.2 |

Only a small amount of coke is formed in the process of the invention. Such a small amount can be processed out and burned to generate steam or recycled to the coal step.

The spent sand recovered at the end of the process will generally contain latent heat, coke and generally not more than 1 to 2% unrecovered carbon. The BTU units are preferably recycled to use in the preheating of the raw sand particles and the remaining sand sold or otherwise disposed.

The fractionation of the volatile hydrocarbons, e.g. above-described condensates, can be accomplished by any suitable means. The present process presents a special advantage in that the condensates to be volatilized are already at an elevated temperature, e.g. about 500° F. to 700° F., and the fractionation process can be accomplished without having to raise the temperature of the condensates before introduction into the fractionation column. Suitable products from such fractionation include the light distillates, such as gasoline, middle distillates, such as jet fuels, diesel fuel and heating oil, and the residual products, such as asphalts. A partial range of products that can be obtained from the condensates derived from the pyrolysis of tar sands include:

| | | |
|---|---|---|
| $C_{+}^{5}$–200° C. | Gasoline | 9.8 |
| 200–275° C. | Kerosene | 11.3 |
| 275–325° C. | Gas oil | 9.7 |
| 325–400° C. | Heavy gas oil | 17.7 |
| 400–535° C. | Vacuum gas oil | 32.6 |

The quantity of these components, and particularly those in the lighter oil range, are significantly improved by the presence of the hydrogen in the treating gas as shown in the example at the end of the specification.

The enriched syn gas removed at the top of the fractionation column contains valuable components and can be used for further reaction to form valuable by products. For example, the gas can be combined with the nitrogen available for the coal gasification step to form valuable liquid ammonia or passed through a catalytic convertor to form methanol.

The operation of the process of the invention is illustrated by the following example showing the use of hot syn gas obtained from the gasification of eastern coal for the pyrolysis of Asphalt Ridge Tar Sands described above.

5,000 lbs. of eastern coal was dried to between 2% and 8% moisture and crushed to particle size of about ¾ inch. The crushed coal was conveyed into a feed bin where it was continuously discharged into a mixed nozzle where it was entrained in oxygen and low pressure steam. Moderate temperature and high burner velocity prevented the reaction of coal and oxygen before entry into the gasification zone. The oxygen, steam and coal reacted in the gasifier at a temperature of 3330° F. The carbon and volatile matter of the coal was gasified, and the coal ash converted into molten slag. About 50–70% of this slag dropped into a water quench tank and was carried from the tank to the disposal system as a granular solid, and the remainder is entrained in the gas exiting the gasifier. Gas leaving the gasifier is quenched to remove any entrained slag droplets and then passed through a heat exchanger to reduce the temperature to about 1800° F.

Asphalt Ridge Tar Sands was crushed to particle size of about ¾ inch and passed into a preheater where it was preheated to a temperature of 250° F. and then taken by screw conveyor to the rotary kiln. The particles were cascaded over the hot syn gas at 1800° F. obtained from the coal gasifcation process described above. The resulting temperature in the kiln was about 700° F. The kiln was rotated at about 30 rpm and the residence time in the kiln was about 12 minutes. The vapors and spent solid were then passed to the separator hopper. The spent sand was removed at the bottom by screw conveyor and the vapors and gas taken to a cyclone where fine particles were removed and thence to the fractionation column. The data from this run is shown in the table below:

| | |
|---|---|
| Bitumen content of freed wt % | 11.67 |
| Tar sand feed rate, lbs/hr | 3.90 |
| Pyrolysis Bed Temperature, °F. | 700° F. |
| Oil yield, wt % | 52.7 |
| Gas yield, wt % | 15.7 |
| Coke yield, wt % | 7.8 |
| Total yield, wt % | 76.2 |
| API Gravity of oil, 20° C. | 15.2 |

-continued

| | |
|---|---|
| Viscosity of oil, cps. 25° C. | 102 |

The oil was subjected to fractionation with the following results:

| | |
|---|---|
| Gasoline, wt % | 11.2 |
| Kerosene, wt % | 11.0 |
| Gas oil, wt % | 9.7 |
| Heavy gas oil, wt % | 17.7 |
| Vacuum gas oil, wt % | 32.7 |
| Residue | 17.7 |

The above process repeated without the use of a gas containing hydrogen gives products which were much lower in the light end products. As noted above, the presence of the hydrogen gives from 5% to 25% increase in the yield of the light end products.

The above process was repeated using Tar Sand Triangle Sands and Sunnyside Tar Sands with related results.

The process of the invention can be operated on a batch, semi-continuous or continuous manner and is ideally suited for large scale continuous operation. A plant designed to handle 60,000 tons of sand a day would yield 40,000 barrels a day of oil plus 1150 tons of liquid ammonia by-products or equivalent 21,000 barrels of methanol.

The invention may be embodied in other specific forms without departing from the spirit or essential characteristics of the invention. The present embodiment is, therefore, to be considered in all respects as illustrative and not restrictive, the scope of the invention being indicated by the appended claims rather than by the foregoing description, and all changes that come within the meaning and range of equivalency of the claims are therefore to be embraced therein.

I claim:

1. A thermal process for treating crushed hydrocarbonaceous solids to extract oils and hydrocarbons therefrom which comprises preheating the crushed hydrocarbonaceous solids to remove any residual water, treating the preheated crushed hydrocarbonaceous solids with hot syn gas containing hydrogen at an elevated temperature and low pressure below 15 psi in the absence of water, in a substantially horizontal rotary kiln having a slight slope downward wherein the crushed solids are introduced at the upper end of the sloped kiln and cascade into the hot gas containing hydrogen for sufficient time to strip the volatile liquids and gases found in the said solids, removing the vaporized materials, enriched syn gas and spent solids from the kiln, fractionating the vaporized materials and enriched syn gas into the desired fractions.

2. A process as in claim 1 wherein hot gas containing hydrogen is brought into the kiln at a temperature between 1000° F. and 2500° F.

3. A process as in claim 1 wherein the crushed hydrocarbonaceous solids are tar sands containing from 10% to 50% by weight of hydrocarbonaceous material.

4. A process as in claim 1 wherein the crushed hydrocarbonaceous solids are preheated to a temperature between 100° F. and 350° F. before being introduced into the kiln.

5. A process as in claim 1 wherein the pressure varies from about 5 psi to 15 psi.

6. A process as in claim 1 wherein the residence time of the solids in the kiln is from 10 to 20 minutes.

7. A process as in claim 1 wherein the crushed solids is oil shale.

8. A process as in claim 1 wherein the hot gas containing hydrogen is obtained from coal gasification.

9. A process for thermal extraction of tar sands using hot syn gas containing hydrogen and carbon monoxide obtained from the gasification of coal which comprises:

(a) introducing crushed coal into a gasifier where it is contacted with oxygen and steam and yields a syn gas containing hydrogen at a temperature of about 3000° F. to 3600° F., (b) removing the hot syn gas and cooling it to a temperature between 1000° F. and 2500° F., (c) introducing the cooled gas into a substantially horizontal rotary kiln sloping downward at an angle of about 3 to 5 degrees where it is mixed, in the absence of water, with crushed tar sands which has been preheated to a temperature between 100° F. and 350° F., and is introduced at the upper end of the sloped kiln, the pressure of the kiln being below 15 psi, (d) maintaining the mixture in the kiln for sufficient time to strip the hydrocarbons found in the tar sand from the particles of sand, (e) removing the volatilized material, gas and spent hot sand from the kiln, (f) disposing of the hot sand and taking the volatilized material and gas to a fractionator where the material is separated into the desired fractions, (g) removing the enriched gas containing hydrogen and carbon monoxide.

10. A process as in claim 9 wherein the tar sands is a Utah tar sands containing from 10% to 50% by weight of hydrocarbonaceous material.

11. A process as in claim 9 wherein the tar sand particles are crushed to a size below about ¾ inch.

12. A process as in claim 9 wherein the kiln is rotated at a rate of 10 to 100 rpm and the residence time is between 10 and 20 minutes.

13. A process as in claim 9 wherein the products taken from the kiln comprises 5 to 10% gas, 60 to 85% volatilized condensates and 5 to 10% coke.

14. A process as in claim 9 wherein the fractions include gasoline, kerosene, gas oil, heavy gas oil and vacuum oil.

15. A process as in claim 9 wherein the enriched gas taken from the fractionator is passed through a catalytic converter to form methanol.

16. A process as in claim 9 wherein the enriched gas taken from the fractionator is combined with nitrogen from the coal gasification process to produce liquid ammonia.

17. A process as in claim 9 wherein the rotary kiln is a horizontal brick lined kiln rotating at a rate of about 10 to 100 rpm.

* * * * *